US006506112B1

(12) United States Patent
Halbleib et al.

(10) Patent No.: US 6,506,112 B1
(45) Date of Patent: Jan. 14, 2003

(54) VENTILATOR FOR A GLASS BLOCK WINDOW AND ASSOCIATED PRODUCTS

(75) Inventors: Patrick Halbleib, Pittsburgh, PA (US); Bruce Ivan, Chicora, PA (US)

(73) Assignee: Monroeville Glass Block Company, Verona, PA (US)

( * ) Notice: Subject to any disclaimer, the term of this patent is extended or adjusted under 35 U.S.C. 154(b) by 0 days.

(21) Appl. No.: 09/524,929

(22) Filed: Mar. 14, 2000

(51) Int. Cl.[7] ..... E06B 7/02
(52) U.S. Cl. ..... 454/225; 52/202
(58) Field of Search ..... 454/225, 212; 52/202, 209, 306

(56) References Cited

U.S. PATENT DOCUMENTS

| | | | | | |
|---|---|---|---|---|---|
| 161,910 | A | * | 4/1875 | Stevens | 454/217 |
| 355,904 | A | * | 1/1887 | Abrahamson | 454/212 |
| 843,139 | A | * | 2/1907 | Feldman | 160/180 |
| 1,765,745 | A | * | 6/1930 | Strom | 454/217 |
| 1,836,852 | A | * | 12/1931 | Kubatzky | 454/212 |
| 2,063,546 | A | * | 12/1936 | Friedholdt, Jr. | 454/212 |
| 2,130,811 | A | * | 9/1938 | Nelson | 454/225 |
| 2,273,758 | A | * | 2/1942 | Kubatzky | 454/273 |
| 2,644,557 | A | * | 7/1953 | Westman | 454/225 |
| 2,738,838 | A | * | 3/1956 | Sutter | 160/95 |
| 2,818,611 | A | * | 1/1958 | Andree | 160/92 |
| 3,791,280 | A | * | 2/1974 | Williamson | 454/225 |
| 4,599,836 | A | * | 7/1986 | Melcher | 52/202 |
| 4,989,502 | A | * | 2/1991 | Ospelt | 454/275 |
| 5,315,798 | A | * | 5/1994 | Zarwell | 454/225 |
| 5,319,879 | A | * | 6/1994 | Rozycki | 49/61 |
| 5,511,352 | A | * | 4/1996 | Sholton | 52/306 |
| 5,675,948 | A | | 10/1997 | Boesch | |

FOREIGN PATENT DOCUMENTS

| | | | | | |
|---|---|---|---|---|---|
| FR | 351090 | A | * | 7/1905 | 454/212 |
| GB | 274719 | A | * | 7/1927 | 454/212 |

* cited by examiner

*Primary Examiner*—Derek Boles
(74) *Attorney, Agent, or Firm*—David V. Radack; Eckert Seamans Cherin & Mellott, LLC

(57) ABSTRACT

The invention comprises a ventilator for a glass block window that includes a window frame, a window sash pivotably mounted in the window frame and a screen also pivotably mounted in the window frame. The window sash is pivotable between a closed position and an open position such that when the window sash is in the open position, rain and snow and the like are resisted from passing through the ventilator and into the building which has the glass block window. The invention also encompasses providing a ventilator as described above without the screen. Finally, a screen for a window is also provided. The screen is pivotably mounted to the window frame of the window. This screen can be used not only for the ventilator but also for other types of windows.

18 Claims, 4 Drawing Sheets

VENTILATOR FOR A GLASS BLOCK WINDOW AND ASSOCIATED PRODUCTS

BACKGROUND OF THE INVENTION

1. Field of the Invention

This invention relates to a ventilator for a glass block window and associated products.

2. Background Information

Ventilators for glass block windows are known. For example, U.S. Pat. No. 5,675,948 discloses such a ventilator in which a sash tilts away from a frame that is mounted in a glass block window. The sash, however tilts such that rain, snow and the like can be captured by the sash and directed into an opening in the ventilator. This particular ventilator also includes a screen disposed interiorly of the sash, however, that screen appears to be fixedly mounted in the frame, thus making removal thereof difficult, if not impossible.

What is needed is an improved ventilator for a glass block window that overcomes the shortcomings of the prior art, and particularly, the ventilator shown in U.S. Pat. No. 5,675,948.

SUMMARY OF THE INVENTION

The invention has met or exceeded the above-captioned needs as well as others. A ventilator for a glass block window is provided that includes a window frame, a window sash pivotably mounted in the window frame and a screen also pivotably mounted in the window frame. Preferably, the window sash is pivotable between a closed position and an open position such that when the window sash is in the open position, rain and snow and the like are resisted from passing through the ventilator and into the building which has the glass block window.

The invention also encompasses providing a ventilator as described above without the screen. Finally, a screen for a window is also provided. The screen of the invention is pivotably mounted to the window frame of the window. This screen can be used not only for the ventilator but also for other types of windows.

BRIEF DESCRIPTION OF THE DRAWINGS

A full understanding of the invention can be gained from the following detailed description of the invention when read in conjunction with the accompanying drawings in which.

DETAILED DESCRIPTION

Figure 1:
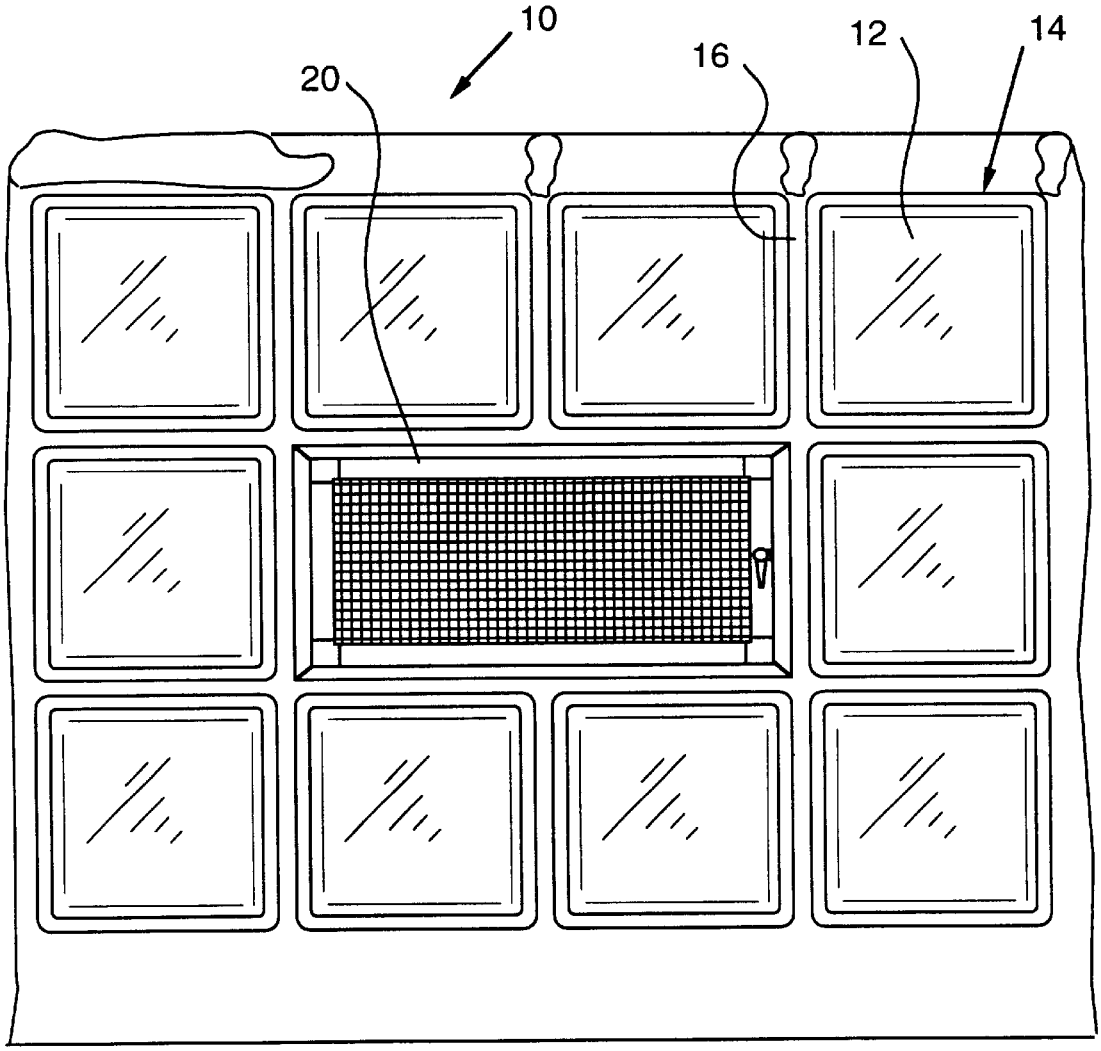
FIG. 1 is an elevational view of a glass block window looking from the inside of a building in which the glass block window is installed.

FIG. 1 shows a glass block window 10. The glass block window 10 consists of a plurality of square glass blocks, such as glass block 12, arranged in a rectangular shape to form a completed glass block panel 14. The glass blocks are joined together with a bonding type material 16 such as, for example, mortar. The ventilator 20 of the invention is mounted, preferably, in the center of the glass block window. As is known, the ventilator 20 provides a method of providing ventilation to an area enclosed by the glass block window 10.

Figures 2, 2A, 2B:
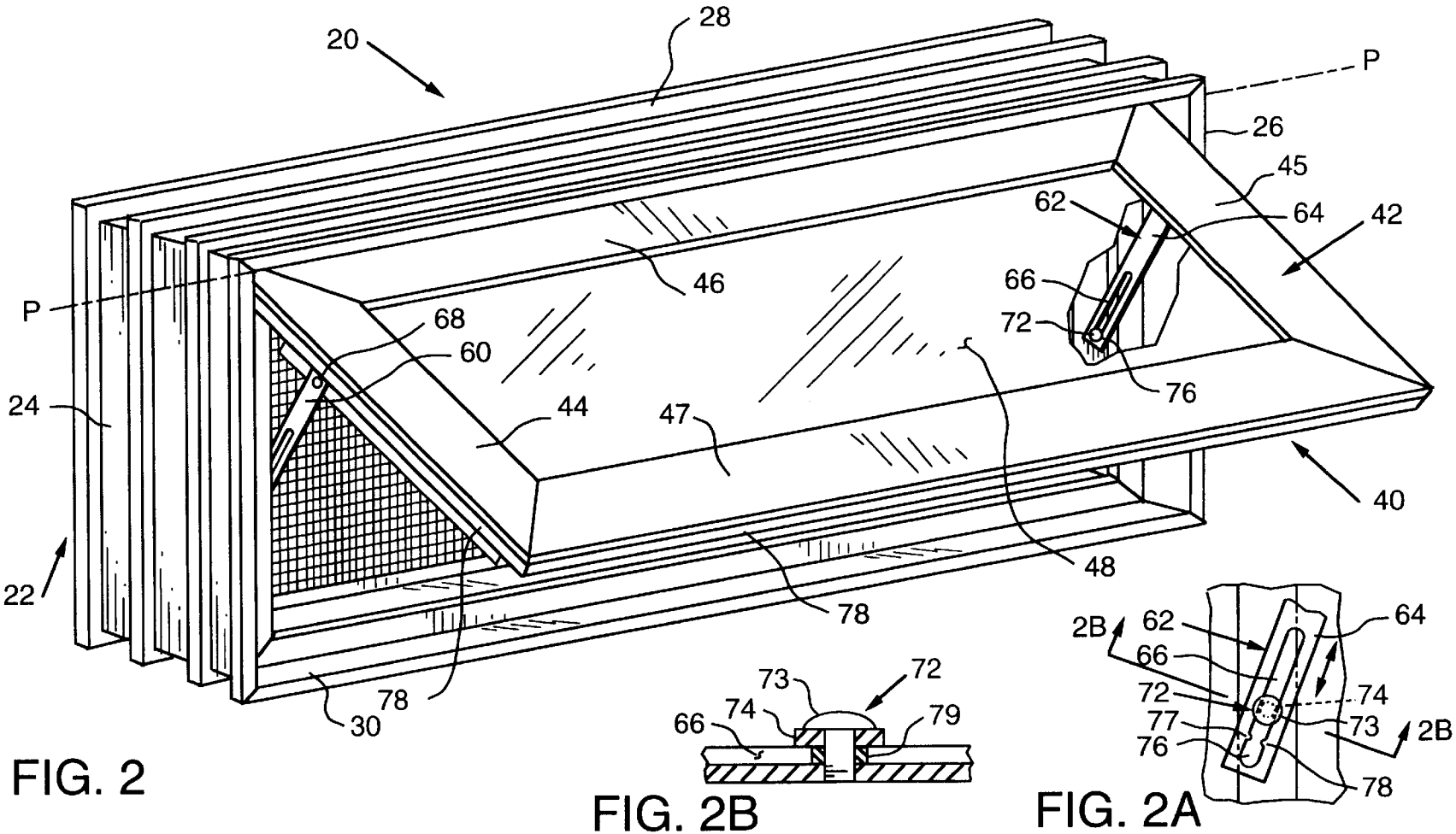
FIG. 2 is a perspective view, partially cutaway, showing the ventilator separated from the glass block window and also showing the window sash in an open position.
FIG. 2A is a detailed view of one of the hinge members.
FIG. 2B is a cross-sectional view taken along line 2B—2B of FIG. 2A.
Figure 3:
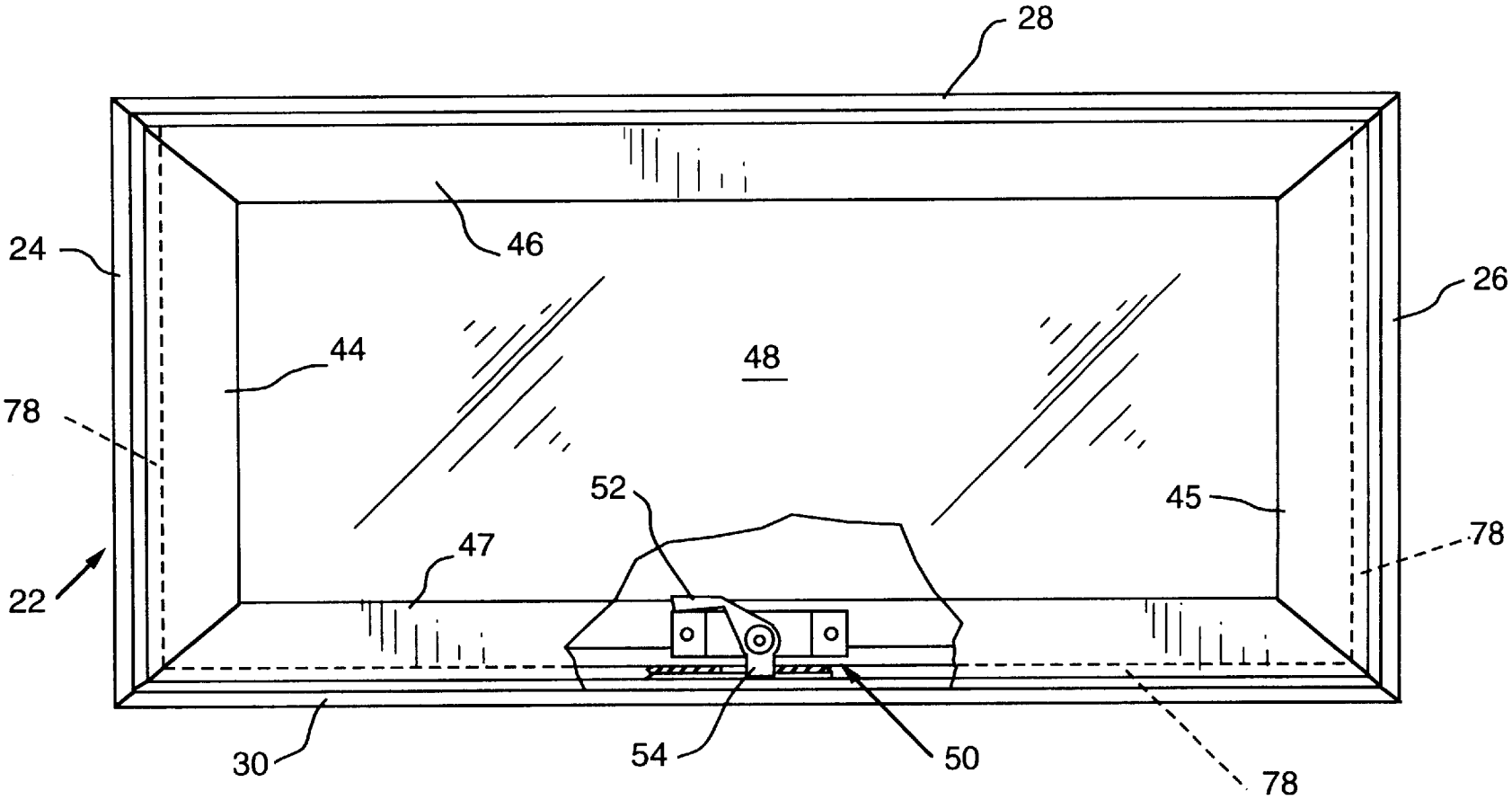
FIG. 3 is an elevational view, partially cutaway, showing the ventilator separated from the glass block window and also showing the window sash in a closed position.

Referring now more particularly to FIGS. 2 and 3, the ventilator 20 of the invention will be discussed in more detail. The ventilator 20 includes a frame 22 that is comprised of a left jamb 24, right jamb 26, superior head 28 and interior sill 30. These portions are preferably made of an extruded vinyl, although other materials, such as aluminum, can be used. The vinyl extrusions are welded together to form the frame 22. In accordance with the invention, a sash 40 is pivotably mounted in the frame 22. The sash 40 shown is rectangular in shape and corresponds to the dimensions of the opening in the frame 22. The sash 40 is fixed to the superior head 28 of the frame 22 and pivots about a pivot line P—P that is generally horizontally disposed. The sash 40 includes a sash frame 42, which includes a vertical left portion 44, a vertical right portion 45, a horizontal top portion 46 and a horizontal bottom portion 47. Portions 44–47 are separate miter cut extruded vinyl pieces which are welded together. Mounted in the sash frame 42 is a double panel window 48. The window 48 is mounted by any known means. It can be appreciated that the exterior pane of glass can be translucent to obscure any view into the building through the glass. The interior pane of glass can be transparent.

FIG. 3 also show the sash latch 50. This is a standard pivotable latch including an extended handle portion 52 and a lower tab portion 54 that is adapted to fit into an engaging portion 56 formed in frame 22.

Referring to FIGS. 2, 2A and 2B, the sash 40 is pivotably mounted to the frame 22 by means of a pair of hinge members 60, 62. Each hinge member 60, 62 is similar in construction. Each hinge member includes a bar, such as bar 64 defining a lower slot 66 of hinge member 62. A fastener attaches a first end of the bar to vertical portions of the sash frame. FIG. 2 shows one such fastener 68 which is attached to sash frame member 44. A second fastener, such as fastener 72 of hinge member 62, is attached to the right jamb 26. The fastener 72 includes a head portion 73 and an underlying washer 74. The head portion 73 and washer 74 preferably have a diameter greater than the width of the slot 66. The second fastener 72 is disposed in the lower slot 66 (FIG. 2A). It will also be seen that the lower slot 66 also defines a notched area 76 defined by inwardly facing notches 77 and 78. The fastener 72 includes a bushing 79 on which the bar 64 slides against.

In operation, when it is desired to move the sash 40 from the closed position (FIG. 2) to the open position (FIG. 3), the sash 40, if necessary, is unlocked from the frame 22 by using the sash latch 50. The user then pushes the sash frame 42 near its bottom to cause the bottom to pivot away from the frame along the pivot line P. The pivot line P is generally horizontal in orientation and is disposed generally along the upper portion of the frame 22, as is shown in FIG. 2. This at first causes the bar 64 to rotate, and then to move upwardly along an angular path due to the second fastener 72. At some point, the second fastener 72 engages the notches 77 and 78. At that point the user applies a greater outward pressure on the sash 40 to allow the bar 64 to keep moving upward and beyond the notched area 76. Once the second fastener 72 is past the notched area 76, the sash 40 is in its full open position (FIG. 3) and will stay there due to the presence of the notches 77 and 78.

There are several advantages to this structure and operation over the prior art. The greatest advantage is that the sash forms an awning that resists the entry of snow and rain into the opening of the ventilator. This can also include water runoff from the sides of the building in which the glass block window is mounted. This arrangement prevents moisture from lying on the interior sill 30 of the frame 22, thus increasing the effectiveness and useful life of the ventilator.

In order to return the sash 40 to the closed position (FIG. 3), the process is reversed, with an extra inward force from the user being used to clear the second fastener 72 past the notched area 76. The sash 40 is then pivoted back to the closed position (FIG. 2) and sash latch 50 is locked.

FIGS. 2 and 3 also show the large bubble type insulation bead 78 that is disposed around the edge of the sash frame 42. This provides superior insulation properties for the ventilator to reduce heating and cooling costs.

Figure 4:
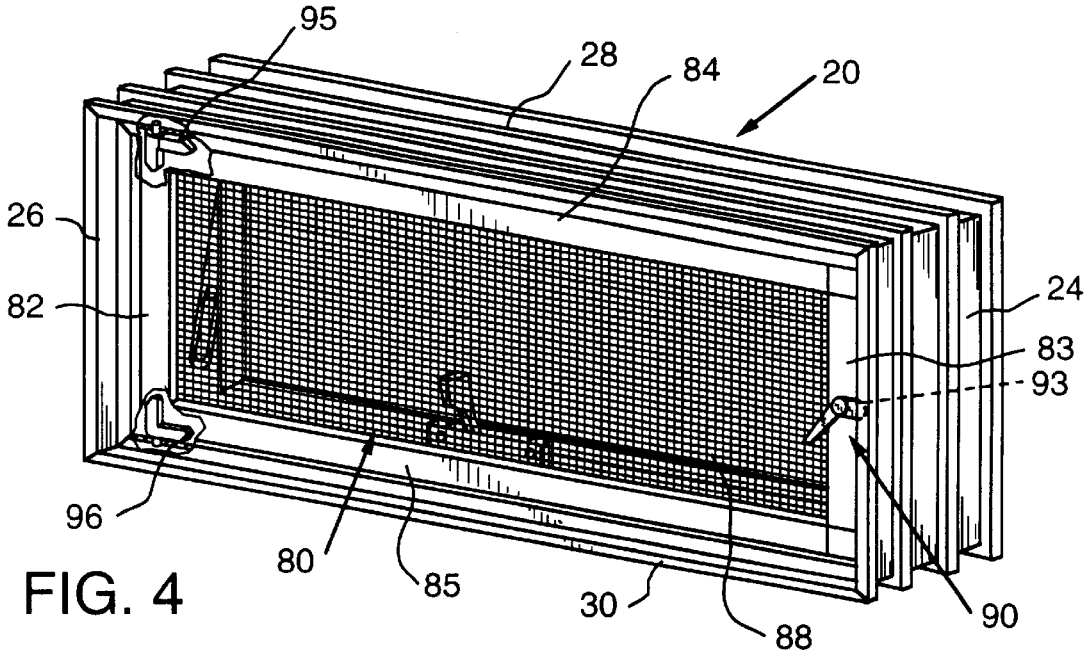
FIG. 4 is a back perspective view, partially cutaway, showing the pivotable screen of the invention in a closed position.
Figure 5:
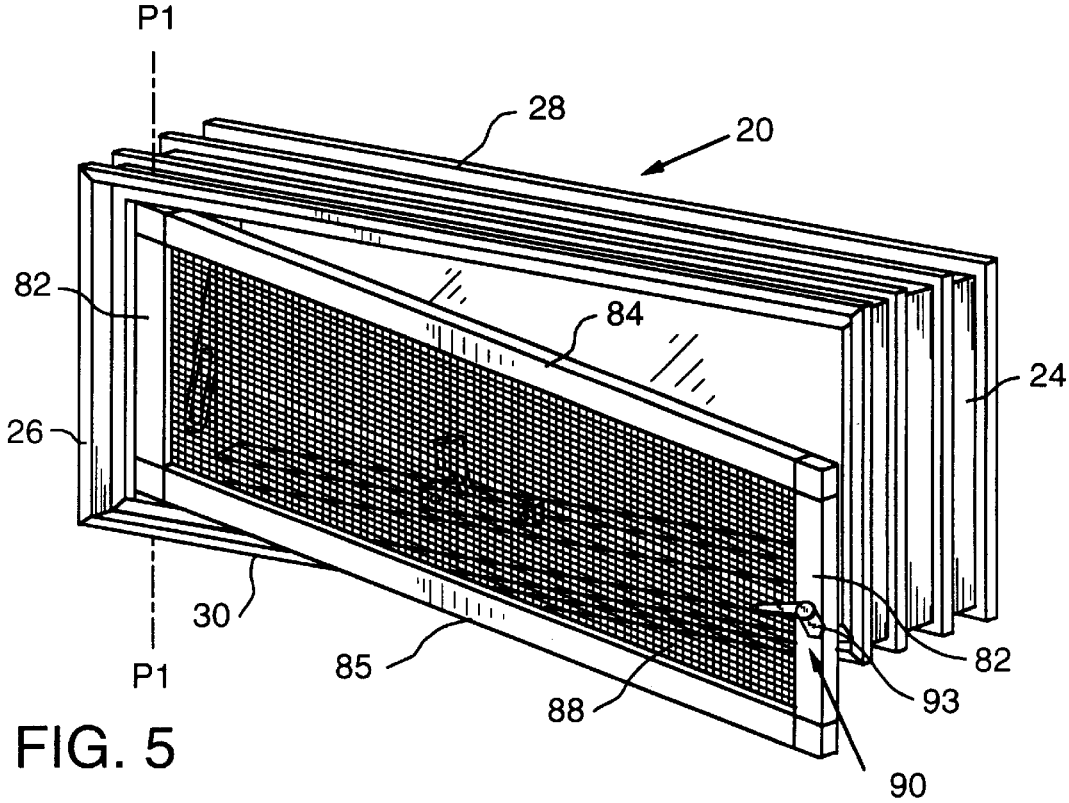
FIG. 5 is a view similar to FIG. 4 only showing the screen pivoted to the open position.

Referring now to FIGS. 4 and 5, the pivotable screen 80 of the invention will be discussed. The pivotable screen 80 can be moved from a closed position (FIG. 4) to an open position (FIG. 5). The screen 80 includes a pair of vertically opposed frame members 82, 83 and a pair of horizontally opposed members 84, 85 which form a frame having an opening in which is disposed a standard mesh screen 88.

The screen 80 is fixed in a closed position by means of a standard screen latch 90 that includes a handle portion and an extending tab portion. As is known, the tab portion 93 engages into an engaging slot formed in the jamb 24.

In order to move the screen 80, it is unlocked (if necessary) and then pivoted to the open position (FIG. 5) on pivot line P1. Preferably, the screen 80 is pivotably mounted in the frame 22 by means of hinge pins 95 and 96 disposed on the upper and lower left hand portions of the screen 80 which engage into complementary holes (not shown) in the frame 32 (FIG. 4). When it is desired to move the screen 80 to the closed position (FIG. 4) the process is merely reversed, and the screen latch 90 is locked.

It will be appreciated that the pivotable screen is not limited to application for glass block window ventilators, but can be used in association with any type of window whether double hung, casement or awning type windows. The advantages of the pivotable screen are numerous. In the case of a ventilator for a glass block window, the pivotable screen allows for easy access of entry for certain household items, such as garden hoses and electrical cords. With the prior art ventilators, this was not possible, as the screen was fixed in the frame. Furthermore, the pivotable screen allows for easier access to clean the interior of the sash and the interior portion of the window. If the screens are used on double hung windows and thus disposed exteriorly of the window surface, the screen can be merely pivoted out of the way instead of being totally removed, thus making cleaning of the exterior surface of that double hung window much easier.

It will be appreciated that a ventilator for a glass block window is provided that has numerous improvements over the prior art. A pivotable screen, which can be used not only for the ventilator but also for other types of windows, is also provided.

While specific embodiments of the invention have been disclosed, it will be appreciated by those skilled in the art that various modifications and alterations to those details could be developed in light of the overall teachings of the disclosure. Accordingly, the particular arrangements disclosed are meant to be illustrative only and not limiting as to the scope of the invention which is to be given the full breath of the appended claims and any all equivalents thereof.

What is claimed is:

1. A ventilator for a glass block window comprising:

a frame;

a sash having a top portion, said sash being pivotably mounted in said frame;

a screen pivotably mounted to said frame;

said sash being pivotable about a first pivot line, said first pivot line being generally horizontally oriented and disposed near said top portion of said sash; and said screen being pivotable about a second pivot line that is separate and distinct from said first pivot line, whereby said sash and said screen can be pivoted independently of each other.

2. The ventilator of claim 1, including said window sash is pivotable between a closed position and an open position such that when said sash is in said open position, rain and snow and the like are resisted from passing through said ventilator.

3. The ventilator of claim 2, wherein at least one hinge member pivotably attaching said sash to said frame.

4. The ventilator of claim 3, wherein said hinge member includes (i) a bar defining a slot; (ii) a first fastener for fastening a first end of said bar to said sash; and (iii) a second fastener attached to said slot, said hinge member being constructed and arranged to permit said sash to be pivotably movable with respect to said window frame.

5. The ventilator of claim 4, wherein said bar further defines a notched area to permit said sash to be locked in said open position.

6. The ventilator of claim 1, wherein said screen is pivotable between an open position and a closed position about said second pivot line.

7. The ventilator of claim 6, wherein said second pivot line is disposed near one side of said screen such that said screen pivots about a generally vertical line.

8. The ventilator of claim 1, wherein said sash includes a sash latch that engages a first latch opening in said frame in order to lock said sash to said frame when said sash is in said closed position.

9. The ventilator of claim 1, wherein said screen includes a screen latch that engages a second latch opening in said frame in order to lock said screen to said frame when said screen is in said closed position.

10. The ventilator of claim 1, wherein said screen is positioned interiorly of said sash.

11. A glass block window comprising:

a plurality of glass blocks arranged to form a glass block panel, said glass block panel defining an opening; and a ventilator secured in said opening, said ventilator including (i) a frame having an upper portion; and (ii) a sash pivotably mounted to said frame about a generally horizontal pivot line disposed generally along said upper portion of said frame, said sash including a sash frame having mounted therein a window, said sash being pivotable between a closed position and an open position such that when said sash is in said open position, rain and snow and the like are resisted from passing through said ventilator.

12. The ventilator of claim 11, including at least one hinge member pivotably attaching said sash to said frame.

13. The ventilator of claim 12, wherein said hinge member includes (i) a bar defining a slot; (ii) a first fastener for fastening a first end of said bar to said sash; and (iii) a second fastener attached to said slot, said hinge member being constructed and arranged to permit said sash to be pivotably movable with respect to said window frame.

14. The ventilator of claim 13, wherein said bar further defines a notched area to permit said sash to be locked in said open position.

15. The ventilator of claim 11, wherein said sash includes a sash latch that engages a latch opening in said frame in order to lock said sash to said frame when said sash is in said closed position.

16. A screen for a window including a window sash and a window frame, said screen being pivotably mounted to said window frame.

17. The screen of claim 16, wherein said screen pivots about a generally vertical pivot line.

18. The screen of claim 17, wherein said screen includes a screen latch that engages a latch opening in said window frame in order to lock said screen to said window frame when said screen is in a closed position.

* * * * *